US010960417B1

(12) United States Patent
Guglielmo

(10) Patent No.: US 10,960,417 B1
(45) Date of Patent: Mar. 30, 2021

(54) AIR OR WATER BROOM

(76) Inventor: William Guglielmo, Davidsonville, MD (US)

( * ) Notice: Subject to any disclaimer, the term of this patent is extended or adjusted under 35 U.S.C. 154(b) by 0 days.

(21) Appl. No.: 12/973,978

(22) Filed: Dec. 21, 2010

(51) Int. Cl.
*B05B 3/18* (2006.01)

(52) U.S. Cl.
CPC ..... *B05B 3/18* (2013.01)

(58) Field of Classification Search
CPC ..... B05B 3/18; B05B 15/62; B05B 15/622; B05B 15/625; B05B 15/60
USPC ..... 239/532, 754, 428.5; 285/114, 226; 15/172, 203
See application file for complete search history.

(56) References Cited

U.S. PATENT DOCUMENTS 202,713 A * 4/1878 Everett ..... 223/68
1,497,933 A * 6/1924 Oberti ..... A47L 13/11 15/245
3,206,229 A * 9/1965 Kramer ..... 285/114
3,915,382 A * 10/1975 Davis ..... B05B 15/628 239/195
4,095,746 A * 6/1978 Anderberg ..... B05B 1/202 239/754
4,288,886 A 9/1981 Siegler
5,117,530 A * 6/1992 Rank ..... E01H 5/02 15/245
5,271,682 A * 12/1993 Realdon ..... 401/37
5,743,580 A 4/1998 Evans
6,419,415 B1 * 7/2002 Vosbikian ..... A46B 11/06 401/137
6,487,746 B1 * 12/2002 Cioci ..... A47L 13/146 15/119.2
7,059,011 B2 6/2006 Capitani
7,140,325 B2 * 11/2006 Lowe ..... A01K 13/003 119/652

* cited by examiner

*Primary Examiner* — Qingzhang Zhou
(74) *Attorney, Agent, or Firm* — Margaret Anderson

(57) ABSTRACT

In order to clean large surface areas using one device a stream of air or water is directed through a rigid tube and exits from a plurality of holes on a pair of sweeper arms that are connected to the rigid tube. Flexible joints are provided on the sweeper arms in order to allow the sweeper arms to bend. Bushings that are connected together permit the operation sweeper arms to be moved from side to side.

7 Claims, 4 Drawing Sheets

AIR OR WATER BROOM

BACKGROUND OF THE INVENTION

A. Field of the Invention

This device will allow an individual to clean large surface areas, particularly surface areas on decks of vessels, warehouses, or garages. The device is a portable device that can use either an air or water stream and is able to direct the flow using a plurality of jets. A source of air or water is needed to operate the device but is not part of the actual device.

B. Prior Art

There are many other prior art references to devices that can move items, both using a stream of air as well as a stream of water. A representative example of this type of device in the prior art can be found at Siegler, U.S. Pat. No. 4,288,886. This is an air broom device, which is held by an individual and it produces and then forces a stream of air through a nozzle at the end of the device. The air stream may also be directed using a flexible end.

Another example can be found at Joos, U.S. Pat. No. 7,406,742, which is a vacuum device and blower that blows air as well as creating a small vacuum to suck up items, if an when needed.

U.S. Pat. No. 4,095,746. This is a self-supported water sweeper with an intake item as well as wheels and a variety of multidirectional jets.

BRIEF SUMMARY OF THE INVENTION

This device is a water or air broom. A stream of air or water is forced through an interior tube and exits from a plurality of openings near the bottom of the device. While a source of air or water is needed to operate the device, no particular means is being claimed.

A means to regulate the flow of air through the rigid, hollow interior tube is also provided probably with a trigger mechanism. A means to lock the trigger in place may also be provided. At the end of the interior tube are two rigid, hollow, sweeper arms that are connected to the interior tube. The length of the tubes may be adjusted through use of telescoping tubes.

On the surface of the sweeper arms are a plurality of holes that allow the air or water to exit the device. Wheels or skids may also be used on the sweeper arms and multidirectional jets may also be employed to direct the flow or air or water depending on a particular application. A means to close the jets may also be provided.

The sweeper arms can be formed in a variety of different configurations and flexible joints are placed in the sweeper arms that allow the sweeper arms to bend inward if needed.

In order to control the bend of the sweeper arms, a bushing is placed around the interior tube and bushings are also placed on the sweeper arms. The respective bushings are connected to each other using a variety of means probably using a rigid rod. A means to lock the interior tube bushing may also be provided.

The movement of the interior tube bushing controls the movement of the bushings on the sweeper arms to either widen the gap between the sweeper arms or close the gap. The movement of the sweeper arms may be needed in areas that are difficult to clean. The sweeper arms may also move independently of each other.

The interior tube bushing can also be locked in place if needed and wheels or skids may be placed on the bottom of the sweeper arms for ease of use.

NUMBERING REFERENCE

Figure 1:
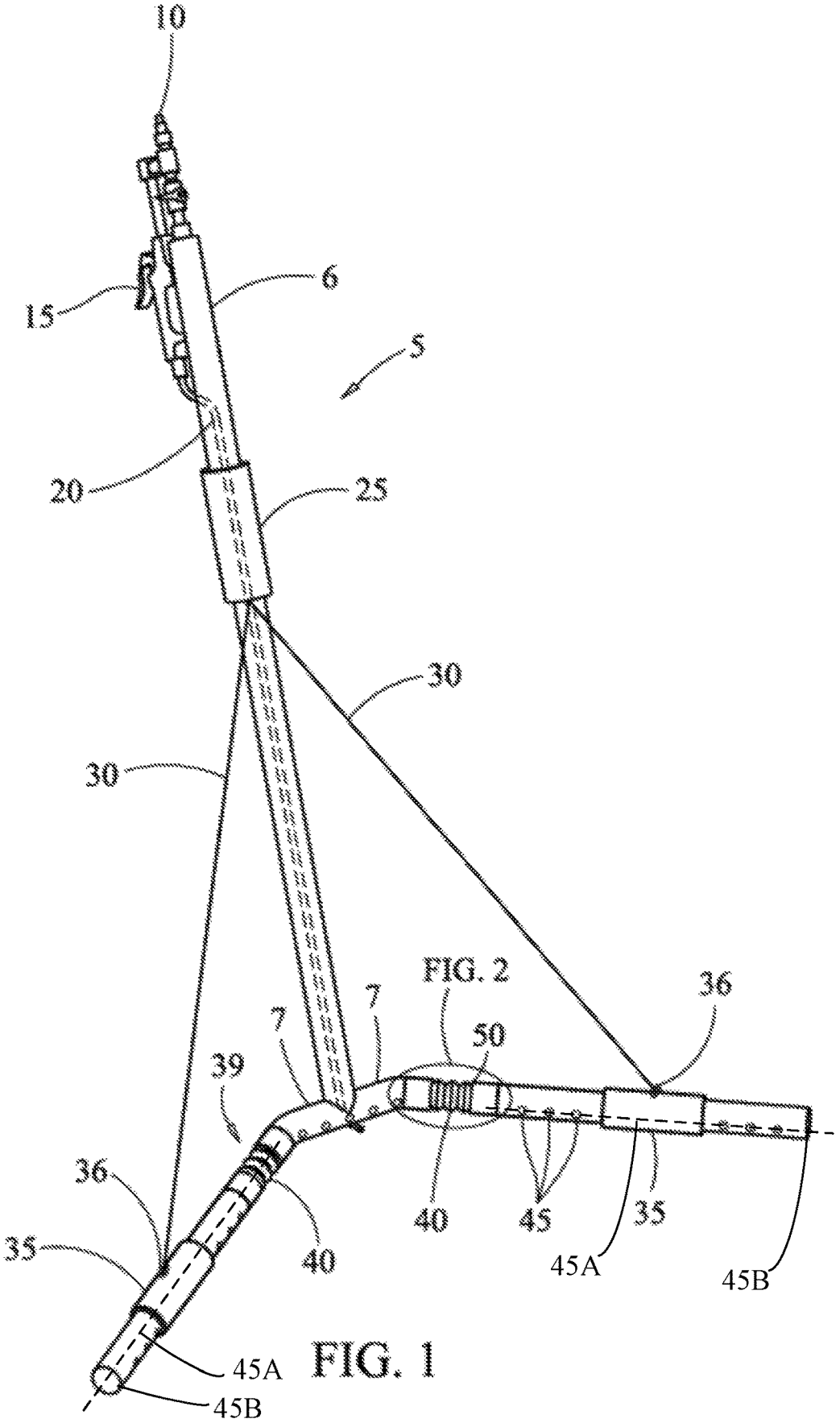
FIG. 1 is an isometric view of the device.

1 Water or Air Source
2 Tubing
5 Device
6 Rigid Tube
7 Sweeper Arms
10 Intake
15 Handle
20 Internal Tubing
25 Tube Bushing
30 Rigid Rods
35 Sweeper Arm Bushings
36 Connection Point
39 Flexible Joint
40 Flexible Member
45 Holes
50 Reinforcing Strips
55 Wheels

DETAILED DESCRIPTION OF THE EMBODIMENTS

This device 5 will be used to clean large volumes of surface areas using one device. It will consist of a first rigid hollow 6 tube with an air or water intake 10 at the first end and a connection point at the second end of the rigid tube.

A source of air or water 1 will be needed to operate the device and tubing 2 will connect the source of air or water to the means to regulate the flow, probably a trigger handle 15. Although a source of air or water is needed to operate the device, no specific means is being claimed. An intake 10 connection is provided to permit the air or water to enter the device.

A means to regulate the flow of the air or water 15, likely a trigger handle, will also be incorporated near one end of the rigid tube. The trigger handle 15 can also be locked into position when needed. Different types of locking means for trigger handles are found in the prior art and no specific means is being claimed.

Internal tubing 20 within the rigid tube 6 will also be used that connects the air or water source to the pair of sweeper arms 7.

Along the rigid tube 6 will be a tube bushing 25, which is attached to a pair of rigid rods 30 that extend from one end of the bushing to a connection point 36 on a pair of sweeper arm bushings 35. One end of the respective rigid rod 30 will be attached to the tube bushing 25 and one end will be attached to a sweeper arm bushing 35 on the pair of sweeper arms 7. As depicted in FIG. 1, the sweeper arm bushing 35 is located on the sweeper arm 7 between the flexible joint 39 and the distal end 45B.

The rods 30 that connect the tube bushing 25 to the sweeper arm bushing 35 should be rigid so that the movement is uniform when the tube bushing 25 is moved. The rigid rods 30 can be disconnected from the sweeper arm bushings 35 in the event that only one bushing is necessary to regulate the flow of air or water through the sweeper arms of the device. In this manner the sweeper arm bushings can operate independently of each other, when it becomes necessary. The sweeper arm bushings 35 are free to move along the sweeper arms 7.

Figure 2:
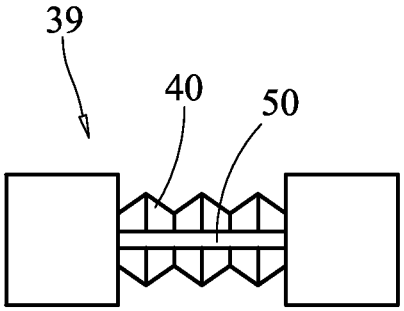
FIG. 2 is a side view of the flexible joint.
Figure 3:
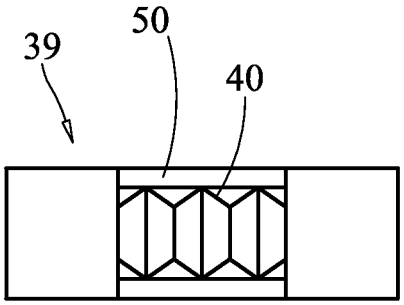
FIG. 3 is a front view of the flexible joint.
Figure 4:
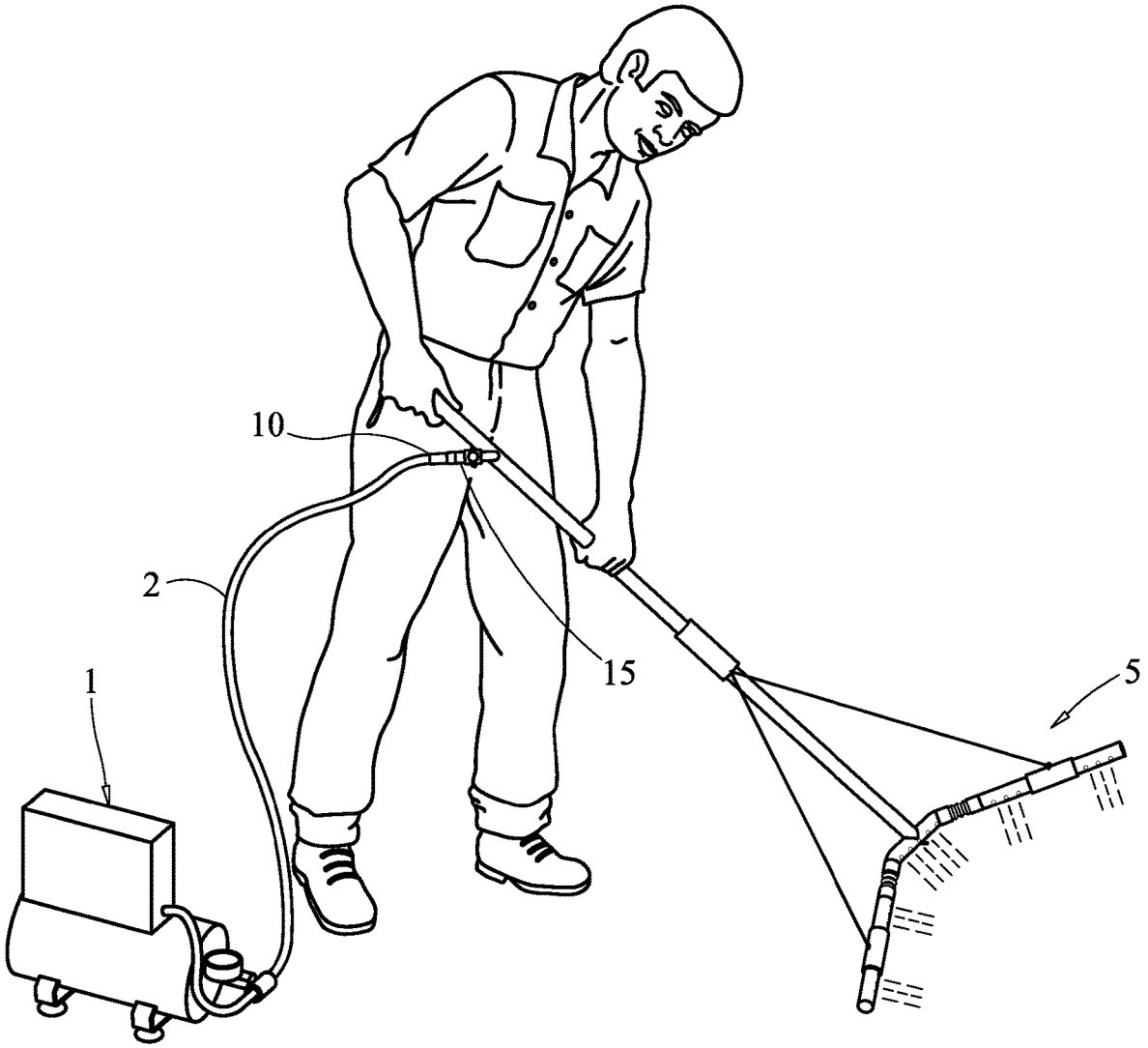
FIG. 4 is an in use view of the device.

Flexible joints 39 will be placed in the sweeper arms to allow the sweeper arms to bend a predetermined amount. As the rigid tube bushing 25 is moved down or up along the rigid tube 6, this will allow the sweeper arms 7 to move from side to side. The flexible joints 39 will be placed in the sweeper arms to allow the sweeper arms to move back and forth. A pair of reinforcing strips 45 will be placed along the edges of the flexible joints 39 to insure that the joint will bend in a uniform manner and prevent crimping while a flexible member 40 will be made a part of the flexible joint 39 such as depicted in FIGS. 2 and 3.

The water or air will travel from the connection at the handle 10 handle through the interior tubing 20 and to the sweeper arms 7. The sweeper arms are internally bored to enable the air to enter the sweeper arms and then exit through a plurality of holes 45 on the sweeper arms. The plurality of holes 45 are located along a sweeper arm longitudinal axis 45A.

The plurality of holes 45 will be used to direct the air or water flow through the device. The ends of the sweeper arms will be capped at ends, such as at the distal ends 45B of FIG. 1, so that the air or water will only flow through the holes that have been provided.

Because surface areas vary greatly and may require some adjustment of the coverage area of the sweeper arms, bushings are placed on the sweeper arms. The sweeper arm bushings 35 are connected to the rigid tube bushing and permit some movement of the sweeper arms as the rigid tube bushing is moved up and down.

Figure 1A:
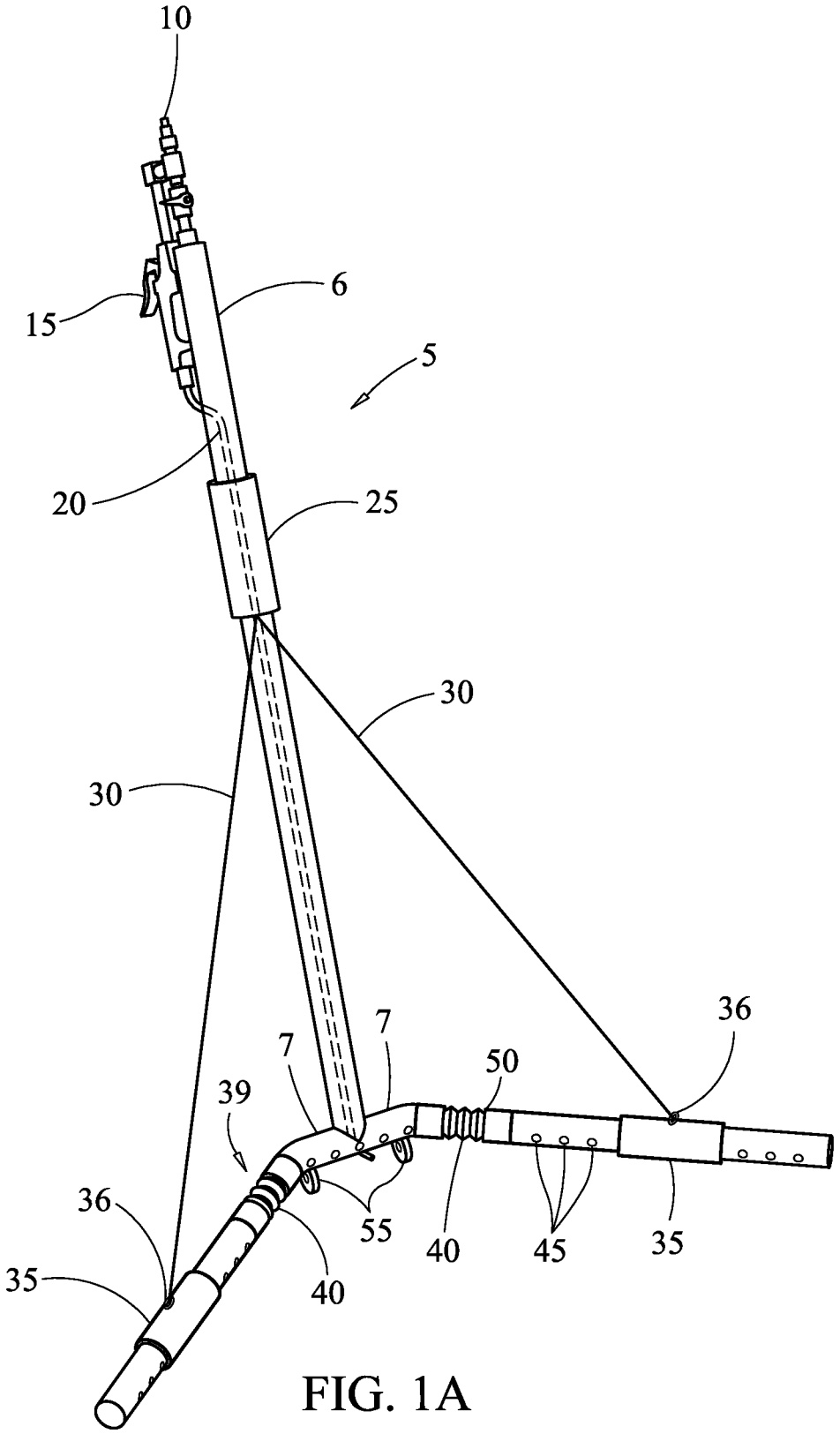
FIG. 1A is an isometric view of the device depicting an alternative embodiment with wheels.

Additionally a means to cap individual holes may also be provided and a means to direct the air with directional jets (not depicted) through the holes 45 may also be used. Because various surfaces may be encountered, wheels 55 such as depicted in FIG. 1A or skids on the bottom (not depicted) of the sweeper arms 7 may also be employed to make the device easier to use on different types of surfaces.

A means to lock (not depicted), such as with a pin that is placed through a bored out section of the rigid tube, the rigid tube bushing in place will also be provided. Wheels 55 on the bottom of the sweeper arms may also be used when using this device.

Telescoping tubes may be used to enable the individual to lengthen the rigid tube and the sweeper arms as circumstances dictate.

While the embodiments of the invention have been disclosed, certain modifications may be made by those skilled in the art to modify the invention without departing from the spirit of the invention.

The inventor claims:

1. A broom comprising:

a first hollow tube having a first end and a second end opposite the first end;

a first sweeper arm and a second sweeper arm connected to the first end of the first hollow tube, wherein each sweeper arm includes a corrugated member, and each sweeper arm forms an obtuse angle at respective joints of each sweeper arm and wherein each of the first sweeper arm and the second sweeper arm is orthogonally coupled to the first hollow tube, and a sweeper plane formed by the sweeper arms, including each obtuse angle at respective joints of the pair of sweeper arms being in obtuse relation to a second plane formed by the first hollow tube with respect to the sweeper plane formed by the sweeper arms to enable the broom to direct airflow when the broom is held by a user, and wherein the sweeper arms are internally bored and comprise a plurality of holes along a longitudinal axis of each sweeper arm in the pair of sweeper arms and a cap at a distal end of each sweeper arm; and a trigger to regulate a flow of air in the first hollow tube and the pair of sweeper arms and through at least the plurality of holes.

2. The broom claim 1, wherein the plurality of holes are capped.

3. The broom claim 1, further comprising wheels on the bottom of the sweeper arms.

4. The broom claim 1, wherein the length of the first tube is adjustable.

5. The broom claim 1 wherein an internal tubing is placed in at least the first hollow tube.

6. A method for an air broom comprising:

providing a large surface area requiring sweeping via a flow of air; and sweeping via the air broom, the air broom including:

a first hollow tube having a first end and a second end opposite the first end; a first sweeper arm and a second sweeper arm connected to the first end of the first hollow tub, wherein each sweeper arm includes a corrugated member, and each sweeper arm forms an obtuse angle at respective joints of each sweeper arm and wherein each of the first sweeper arm and the second sweeper arm is orthogonally and the sweeper plane formed by the sweeper arms, including each obtuse angle at respective joints of the pair of sweeper arms is in obtuse relation to a second plane formed by the first hollow tube with respect to the sweeper plane formed by the sweeper arms, wherein the sweeping via the air broom further includes:

directing airflow when the air broom is held by a user, and wherein the sweeper arms are internally bored and comprise a plurality of holes along a longitudinal axis of each sweeper arm in the pair of sweeper arms and a cap at a distal end of each sweeper arm; and regulating flow of air via a trigger in the first hollow tube and the pair of sweeper arms and through at least the plurality of holes.

7. The method of claim 6 wherein the large surface area is a deck of a ship.

* * * * *